US006422684B1

(12) United States Patent
Ladabaum et al.

(10) Patent No.: US 6,422,684 B1
(45) Date of Patent: Jul. 23, 2002

(54) RESONANT CAVITY DROPLET EJECTOR WITH LOCALIZED ULTRASONIC EXCITATION AND METHOD OF MAKING SAME

(75) Inventors: Igal Ladabaum, San Carlos; Alissa M. Fitzgerald, Menlo Park, both of CA (US)

(73) Assignee: Sensant Corporation, San Jose, CA (US)

( * ) Notice: Subject to any disclaimer, the term of this patent is extended or adjusted under 35 U.S.C. 154(b) by 0 days.

(21) Appl. No.: 09/466,991

(22) Filed: Dec. 10, 1999

(51) Int. Cl.[7] ..... B41J 2/135
(52) U.S. Cl. ..... 347/46
(58) Field of Search ..... 347/46; 310/321

(56) References Cited

U.S. PATENT DOCUMENTS

| | | | | |
|---|---|---|---|---|
| 4,459,601 A | | 7/1984 | Howkins | |
| 4,599,628 A | | 7/1986 | Doring et al. | |
| 5,371,527 A | * | 12/1994 | Miller et al. | 347/46 |
| 5,388,326 A | * | 2/1995 | Beeson et al. | 347/63 |
| 5,565,113 A | * | 10/1996 | Hadimioglu et al. | 347/46 |
| 5,877,580 A | | 3/1999 | Swierkowski | 310/328 |
| 6,036,301 A | * | 3/2000 | Amemiya et al. | 347/46 |
| 6,174,038 B1 | * | 1/2001 | Nakazawa et al. | 347/10 |
| 6,196,664 B1 | * | 3/2001 | Kanda et al. | 347/46 |
| 6,242,266 B1 | * | 6/2001 | Schleifer et al. | 436/518 |

FOREIGN PATENT DOCUMENTS

| | | |
|---|---|---|
| DE | 198 17 531 | 10/1999 |
| DE | 199 58 889 | 6/2000 |
| EP | 0 064 416 | 11/1982 |
| EP | 0 145 130 | 6/1985 |
| EP | 0 501 777 | 9/1992 |
| EP | 0 783 965 | 7/1997 |
| EP | 0 845 357 | 6/1998 |
| JP | 55090374 | 7/1980 |
| JP | 2303849 | 12/1990 |
| JP | 11320868 | 11/1999 |

OTHER PUBLICATIONS

Ultrasonic Cavity Resonance for Ink on Demand Ink Jet Formation, IBM technical Disclosure Bulletin, vol. 18, No. 4, Sep. 1975.*

* cited by examiner

*Primary Examiner*—John Barlow
*Assistant Examiner*—Michael S Brooke
(74) *Attorney, Agent, or Firm*—Pillsbury Winthrop LLP

(57) ABSTRACT

The present invention provides an ultrasonic resonant cavity droplet ejector with localized excitation and a method for making the same. In a resonant cavity with an ultrasonic transducer acting as one of the cavity walls, the energy input from the transducer coupled with the gain of the resonant cavity causes a droplet to be ejected from a nozzle in the cavity wall. In addition, a refill channel can be introduced such that the cavity can be refilled without affecting cavity gain. Arrays of such locally excitable ejector cavities are useful in numerous applications, including, among others, ink-jet printing, DNA chip printing, and fuel injectors.

38 Claims, 8 Drawing Sheets

RESONANT CAVITY DROPLET EJECTOR WITH LOCALIZED ULTRASONIC EXCITATION AND METHOD OF MAKING SAME

BACKGROUND OF THE INVENTION

I. Field of the Invention

The present invention relates to the field of droplet ejectors. More specifically, the present invention relates to droplet ejectors whose excitation is locally controlled, as is the case in ink-jet printers.

II. Description of the Related Art

Many types of droplet ejectors exist, with substantial prior art describing and supporting them. Some droplet ejectors work by ejecting a continuous stream of fluid and subsequently re-directing part of the jet to a specific location. Other types of ejectors, typically classified as drop-on-demand ejectors, produce a drop only when they receive a signal to eject the drop. The invention herein described is of the drop-on-demand type.

Fundamentally, an ejector will release a droplet when the kinetic energy at the liquid-nozzle-ambient interface exceeds the surface tension and adhesion energy of the interface. Several methods are used in order to impart sufficient kinetic energy to the fluid. In certain devices, such as spray nozzles and fuel injectors, pressure is applied to the bulk fluid with a pump. In drop-on-demand devices the energy is often provided thermally or acoustically. Focused acoustic energy, as described in U.S. Pat. No. 5,591,490 and U.S. Pat. No. 5,111,220, is known to eject droplets, though this approach requires the scanning of the focused beam behind the liquid-ambient interface in order to select the location of droplet ejection. Thermal inkjet printers, however, rely on an array of resistors heating an array of fluid cavities. When a given resistor receives a voltage signal, it will heat the ink such that a bubble will form. The formation of this bubble generates sufficient pressure in the fluid to eject a drop from the nozzle. An advantage of thermal technology is the ease with which droplets can be ejected selectively from an array of cavities.

Acoustic inkjet printers are also known which. rely on a piezoelectric element converting an electrical signal to a mechanical displacement that constricts a fluid cavity. The piezoelectric element essentially acts as a piston, which squeezes out a drop from the nozzle. Recent advances in the art have enabled piezoelectric arrays to selectively eject droplets from an array of nozzles. In both thermal and piezoelectric ejectors, droplet ejection rates are currently limited to approximately 10 kHz.

A disadvantage of thermal ejectors is that the liquid is essentially boiled, which requires specific formulations of ink, for example, and precludes the ejection of volatile or organic compounds sensitive to heat.

Piezoelectric ejectors appear to overcome many of the thermal ejectors' limitations, but have some drawbacks of their own. In order to generate sufficient pressures for droplet ejection, substantial displacement is required of the piezoelectric, which limits its ejection rate. Furthermore, fabricating arrays of piezoelectric elements capable of providing relatively large displacements at higher frequencies is a difficult and costly process.

The ejection of droplets by squeezing a fluid cavity with electrostatic force is also generally known for certain applications. These applications are, however, limited, and the fluid is typically subjected to large electric fields, which can charge the liquid or damage the constituents of a solution or suspension of interest. Although methods to reverse the effects of charging have been attempted, such as disclosed in U.S. Pat. No. 5,818,473, damage to the solutions can still occur, for example to sensitive biochemical solutions.

What is needed, therefore, is a droplet ejector capable of ejecting droplets at rates faster than 10 kHz which will neither heat the liquid nor subject it to damaging electric fields. Furthermore, the ejector should be small enough and individually addressable such that an array of ejectors can deposit patterns of droplets quickly, as in printing.

It has been recognized by the present inventors that a judiciously designed cavity with a nozzle and filling channel can be acoustically excited at its resonance frequency and that such resonance will increase the pressure at the nozzle such that droplet ejection occurs. The displacement required of the exciting element is small enough to allow the excitation to be generated by a conventional piezoelectric element or a vibrating diaphragm. It has further been recognized by the present inventors that the resonant cavities can be small enough, and the excitation frequencies high enough to enable addressable arrays of ejectors to generate droplets at a rapid rate and in patterns.

SUMMARY OF THE INVENTION

It is an object of the present invention to provide an ultrasonic droplet ejector from an ultrasonic excitation source, a resonant cavity, and a nozzle.

It is an object of the present invention to provide an ultrasonic droplet ejector with a nozzle and a filling channel such that the flow resistance of the nozzle is sufficiently below that of the filling channel to ensure ejection from the nozzle rather than regurgitation back into the filling channel.

It is an object of the present invention to provide a resonant cavity ultrasonic droplet ejector whose excitation source is a piezoelectric element.

It is an object of the present invention to provide a resonant cavity ultrasonic droplet ejector whose excitation source is a vibrating diaphragm whose motion is generated by the electrostatic attraction of the diaphragm towards a second electrode such that the liquid of interest is not subjected to an electric field.

It is an object of the present invention to provide a resonant cavity ultrasonic droplet ejector where each droplet ejection requires more than one cycle of acoustic excitation, but where the droplet ejection rate is higher than 10 kHz.

It is a further object of the present invention to provide an array of resonant ultrasonic droplet ejectors where each ejector in the array can be independently excited.

The present invention achieves the above objects, among others, by providing a method of forming resonant cavities where at least one wall of the cavity contains an ultrasonic excitation source, where one wall of the cavity contains a nozzle, and where the cavity is connected to a refill channel.

BRIEF DESCRIPTION OF THE DRAWINGS

The features, objects and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention.

Figure 1:
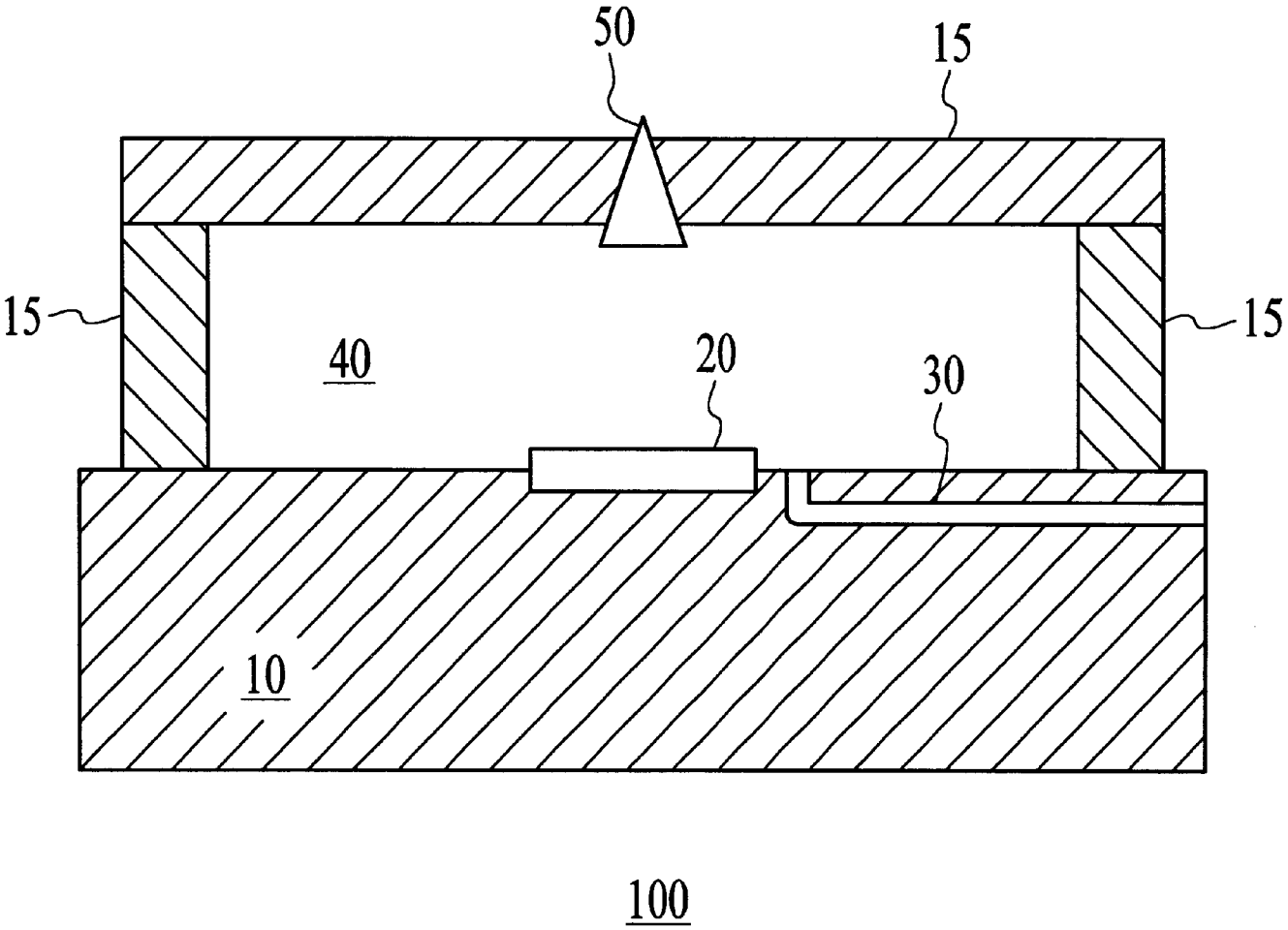
FIG. 1 illustrates a cross section of a resonant ultrasonic droplet ejector where the key conceptual elements are labeled.

A resonant ultrasonic droplet ejector can be made to satisfy a variety of operating specifications. Nevertheless, certain features are extremely beneficial to obtaining a droplet ejector that performs well and is reliable and economical. These features are illustrated in FIG. 1. As illustrated, a resonant ultrasonic droplet ejector 100 requires a rigid walled housing made of a substrate 10 and walls 15 that that define a cavity 40 whose largest dimension in the length, width, and height directions is smaller than the distance an acoustic wave travels during one period of a sinusoidal acoustic signal in the liquid of interest at the frequency of interest. For example, an aqueous resonant ultrasonic ejector operating at 3.2 MHz requires a cavity whose largest dimension is smaller than 500 microns, the approximate wavelength of 3.2 MHz sound in water. It is preferable if the largest dimension is an order of magnitude smaller than the wavelength, so that in this example, the maximum cavity dimension should be 50 microns. This housing is formed by a substrate 10 and walls 15 on the substrate. A resonant ultrasonic droplet ejector further requires a nozzle 50 and refill channel 30 designed such that the flow resistance across the refill channel is much greater than the flow resistance across the nozzle. The substrate 10 and walls 15, which together form a housing that defines the cavity, the associated refill channel 30 and the nozzle 50, can be formed out of any one or a combination of several materials, and the present invention is not limited to the specific materials used as examples, but nevertheless examples are useful and are so provided. The substrate 10 is typically a silicon wafer, the walls 15 are typically made from silicon, glass, steel, or plastic. The refill channel 30 is typically made from the same material as the walls, or sometimes by silicon nitride channels formed within the substrate 10. The nozzle 50 needs to be formed from a rigid material, usually the same as that of the walls. High precision nozzles are made from silicon, with lower precision nozzles made from steel, plastic, and glass. The volume of the cavity 40, the aperture of the nozzle 50, the effective length of the nozzle, and the speed of sound in the liquid of interest determine the resonant frequency of the cavity, as will be described further hereinafter. An ultrasonic excitation source 20 is required which is capable of exciting the cavity at the resonant frequency of the cavity, which excitation source can be, for example, a piezoelectric or diaphragm excitation source. For a given resonant frequency, the maximum pressure gain of the cavity is determined by the inertia of the liquid in the nozzle and by loss mechanisms, which are dominated by the radiation of acoustic energy at the nozzle and the viscous losses at the nozzle. The inertia and losses depend on the effective length of the nozzle and its aperture. Thus, in order to form a functional droplet ejector, cavity 40, nozzle 50, and refill channel 30 dimensions must be chosen such that at the resonance frequency the cavity gain is sufficient for droplet ejection. Of course, the nozzle dimensions also determine the size of the droplet which is ejected.

By way of example only, three such designs are provided. For simplicity, these preferred embodiments are symmetrical, such that the nozzle, centered on one face, is symmetrical, though asymmetrical embodiments, for example a rectangular cavity with a nozzle positioned at ⅓ of the long face, are also feasible. For the first design, there is provided a cubic cavity with an edge length of 50 microns, a nozzle of 4 micron diameter and 50 micron length, and a refill channel of 2 micron diameter and 400 micron length, which requires a transducer of approximately 3.2 MHz and has a maximum cavity gain of approximately 10. It will eject drops with a diameter of approximately 8 microns. For the second design, there is provided a cubic cavity with an edge length of 100 microns, a nozzle of 10 micron diameter and 50 micron length, and a refill channel of 2 micron diameter and 10 micron length, which requires a transducer of approximately 2.7 MHz and has a maximum cavity gain of approximately 50. It will eject drops with a diameter of approximately 20 microns. For the third design, there is provided a cubic cavity with an edge length of 300 microns, a nozzle of 20 micron diameter and 50 micron length, and a refill channel of 2 micron diameter and arbitrarily short length, which requires a transducer of approximately 1 MHz and has a maximum cavity gain of approximately 70. It will eject drops with a diameter of approximately 40 microns. All of the preceding embodiments enable droplet ejection at rates of at least 10 KHz. Some design rule ranges that have been found to be pertinent are that droplet size is approximately twice the nozzle orifice size, and that for a given nozzle orifice, both the resonant frequency and the cavity gain increase monotonically with decreasing cavity volume. The refill orifice diameter is usually very small to ensure no regurgitation, typically in the range of 2 microns. The typical range of nozzle orifice diameter is 2 to 40 microns. The corresponding range of a cubic cavity edge length is 25 to 600 microns. The corresponding range of resonant frequency is 6 MHz to 250 KHz, with the cavity gain ranging from approximately 100 to 2.

Figure 2:
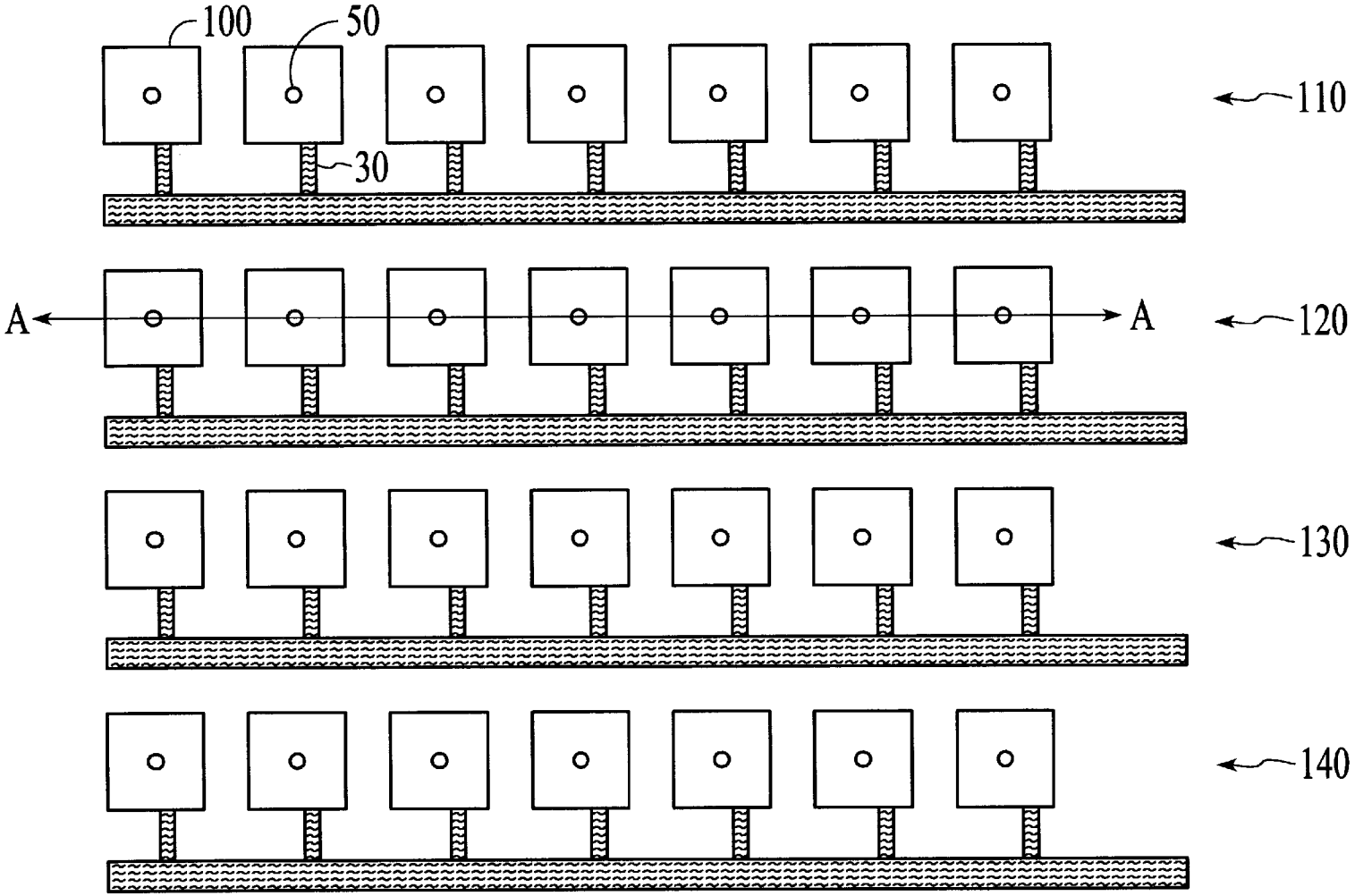
FIG. 2 illustrates a top view of an array of resonant ultrasonic droplet ejectors.
Figure 3:
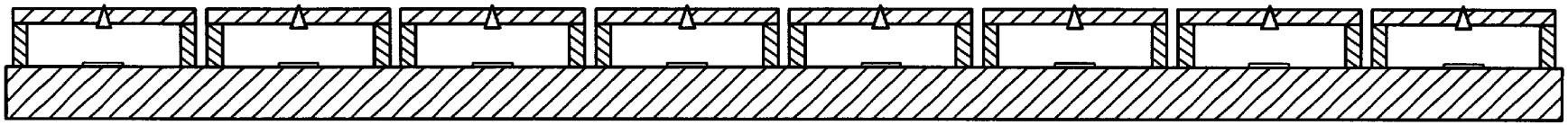
FIG. 3 illustrates a cross section of an array of resonant ultrasonic droplet ejectors taken along plane AA of FIG. 2.

One significant aspect of the present invention is that the resonant cavity is independently excitable by its corresponding ultrasonic source, which enables arrays of such cavities to deposit patterns of droplets quickly. FIG. 2 shows a top view of an array of ejectors 100 with filling channels. By way of example, 4 filling channels are shown, 110, 120, 130, 140 each containing a different liquid. These different filling channels can represent different colors, such as red, yellow, blue and black, for a printing application, or different nucleotide solutions for a DNA chip printer, for example. Grouping individual elements in sets of four provides a specific advantageous grouping that can be used for printing and DNA applications. In the printing application, each group of four would have one color, such as red, yellow, blue and black, whereas in a DNA chip printing application, each group of four would have a different nucleotide solution, for instance. By scanning such an array of ejectors over a substrate of interest, and by individually controlling each ejector 100, patterns can be deposited quickly. A cross-section along plane AA of FIG. 2 is shown in FIG. 3.

Figure 4B:
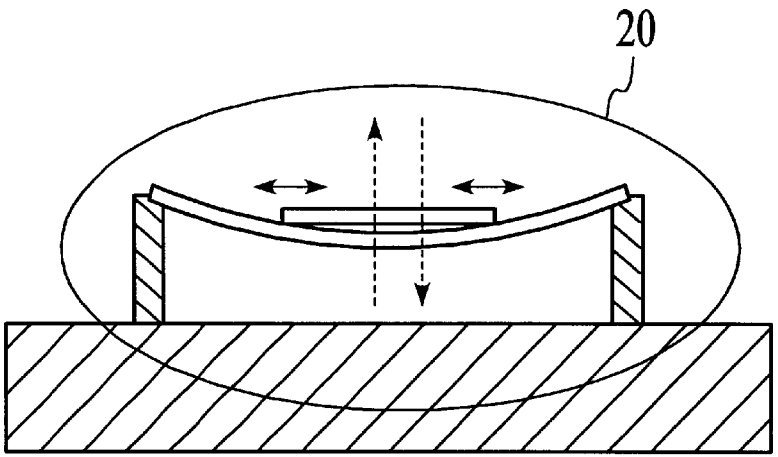
FIG. 4 illustrates a cross section of an ultrasonic droplet ejector with a piezoelectric excitation source.
Figure 4A:
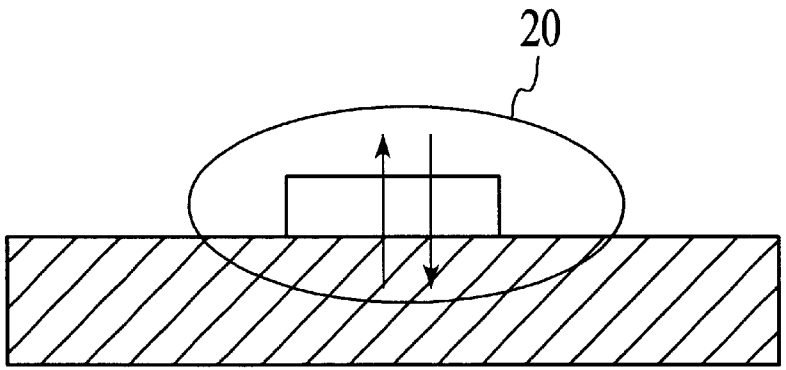

One embodiment of the present invention provides for the ultrasonic excitation source 20 to be made of a piezoelectric element. FIGS. 4*a* and 4*b* show cross sections of such an element. The piezoelectric source can be one of several piezoelectric crystals known in the art, such as PZT-5H, or a polymeric piezoelectric, such as poly-vinyl-di-fluoride (PVDF), or a piezocomposite material. The piezoelectric element can achieve the necessary excitation by way of a longitudinal mode, as is known in the art and is shown in FIG. 4*a*, or by exciting a flexural mode in a diaphragm, as is known in the art and is shown in FIG. 4*b*.

Figure 5:
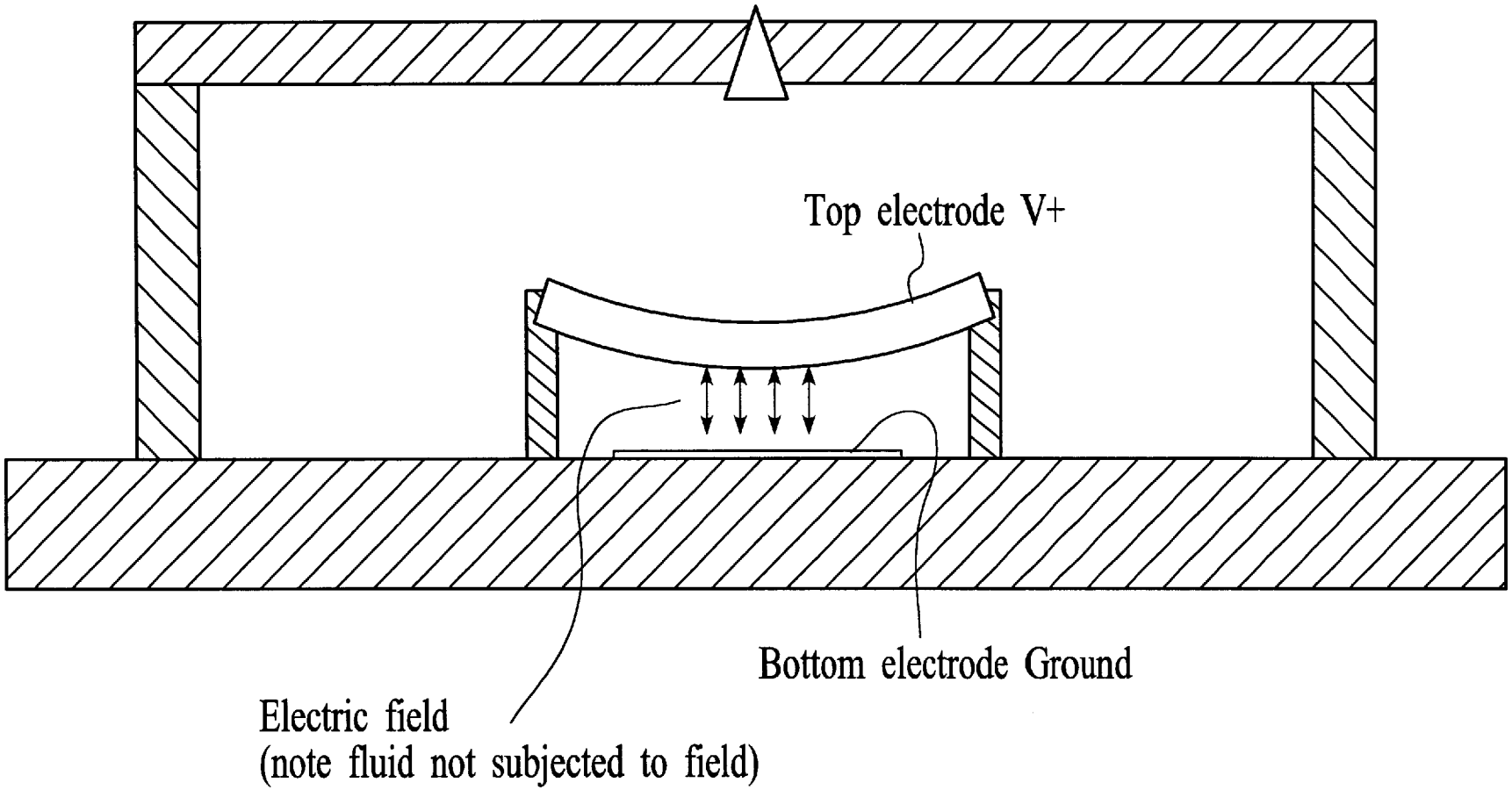
FIG. 5 illustrates a cross section of an ultrasonic droplet ejector with an electrostatic diaphragm excitation source.

Another preferred embodiment of the present invention provides for the ultrasonic excitation source 20 to be made of an electrostatically excited diaphragm. As shown in FIG. 5, an electrostatic diaphragm source does not subject the fluid of interest to high electric fields. A significant advantage of an electrostatically actuated diaphragm is that it is not subject to the operating temperature limitations of piezoelectrics, which depole at relatively low temperatures (a typical piezoelectric crystal begins to de-pole below 100° C.)

One significant advantage of diaphragm excitation, whether piezoelectric as in FIG. 4*b* or electrostatic as in FIG. 5, is that such transducers typically exhibit broader bandwidth. This broader bandwidth facilitates the realization of resonant cavity ejectors because variations in cavity resonance frequency can be accommodated with a single excitation transducer design.

Yet another advantage of diaphragm excitation is that acoustic coupling to the substrate is much lower than in the case of bulk piezoelectric excitation. Significant substrate coupling can preclude the realization of certain ejector designs, so diaphragm excitation enables the broadest range of feasible designs.

The process of fabricating an array of ultrasonic droplet ejectors in accordance with a preferred embodiment of the present invention will now be described with reference to FIGS. 6–8. It should be noted, however, that formation of the device described above can be accomplished by conventional semiconductor and piezoelectric fabrication techniques. Each of the different layers are formed using conventional deposition and etching techniques. Accordingly, from the description provided, one of ordinary skill in the art will be able to make such a device.

Figure 6:
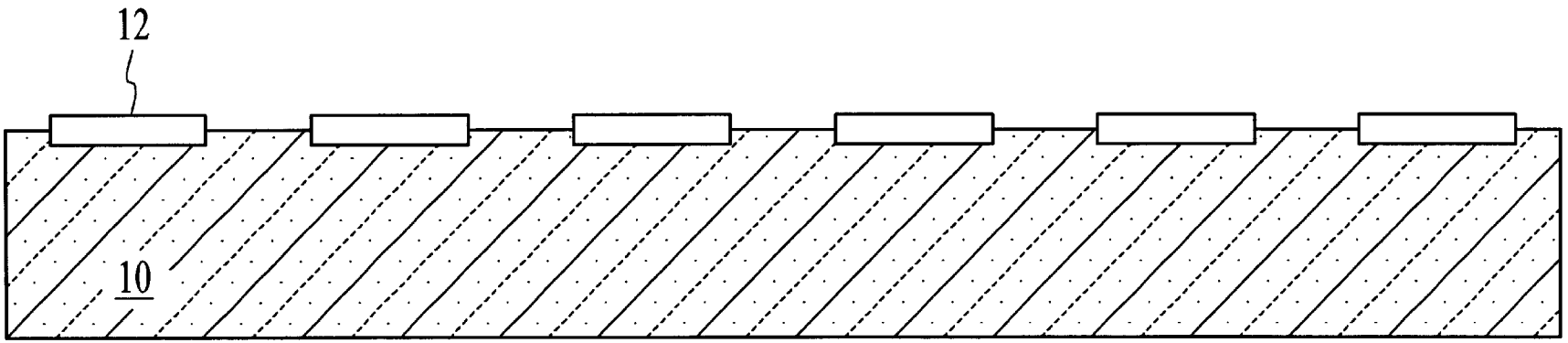
FIGS. 6–8 illustrate the process of fabricating an array of ultrasonic droplet ejectors according to an embodiment of the present invention.

Starting with FIG. 6, the process begins with a silicon or other substrate 10, the surface of which contains ultrasonic excitation sources 20 which have been fabricated with methods similar to those known in the art (medical ultrasound probes, for example). This substrate may contain all electrical connections and circuitry necessary to control the ultrasonic excitation sources.

Figure 7:
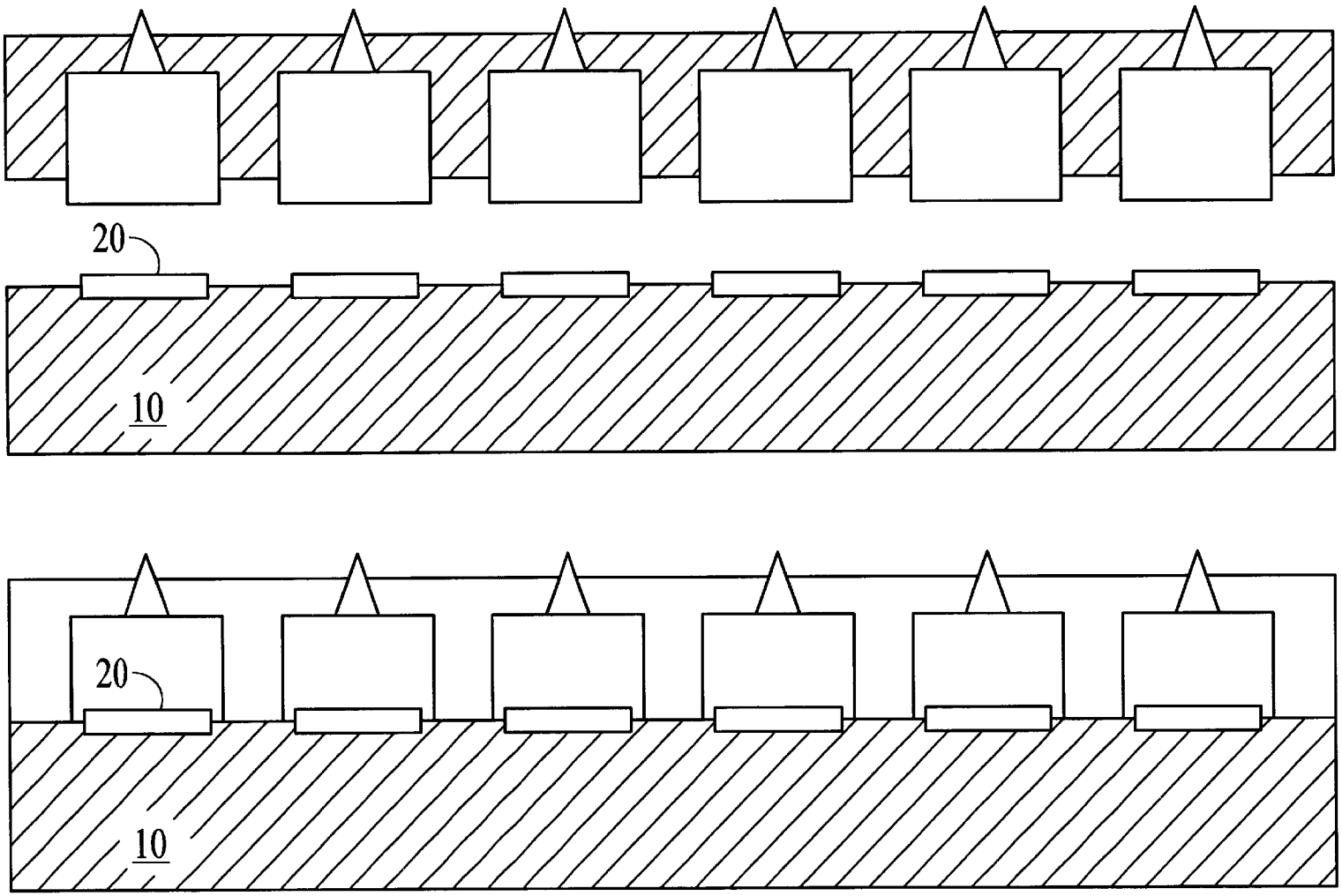
Figure 8:
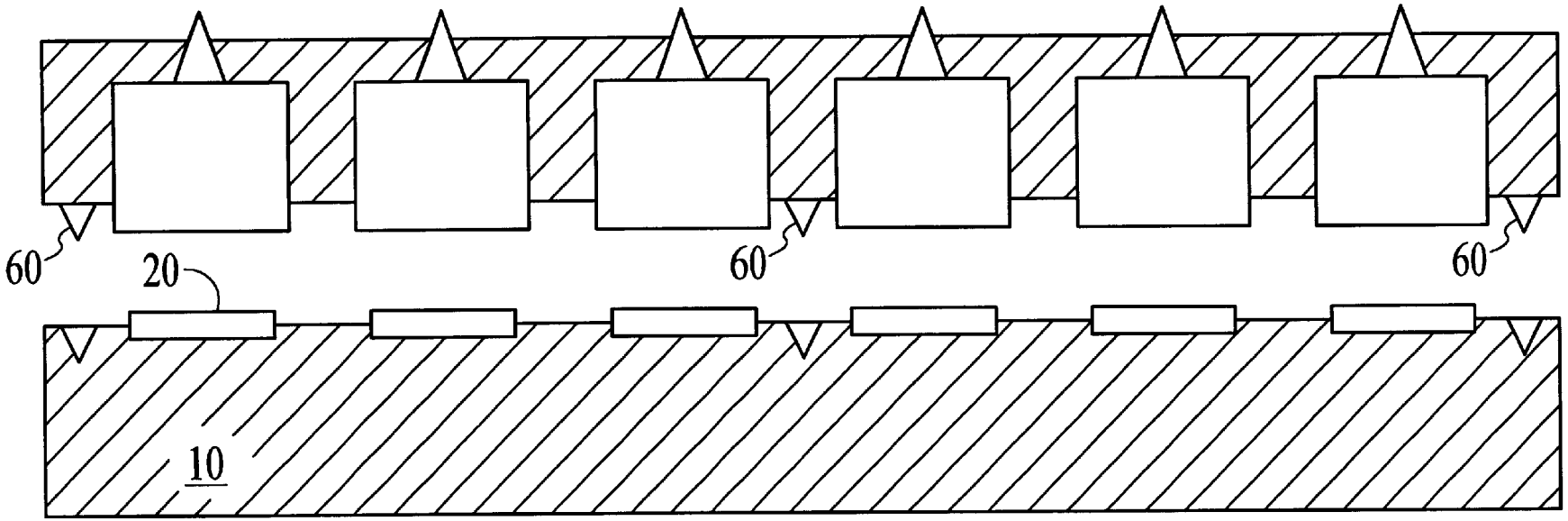

As shown in FIG. 7 there then is formed a nozzle wafer specifically designed to mate with the substrate and thus form the required cavities and filling channels. In a different embodiment of the present invention, the substrate wafer would already contain refill channels of approximately 2 micron diameter. The formation of such a nozzle plate and the mating of such a plate with the substrate can proceed in several different ways. The nozzle plate can be formed from silicon or quartz or glass with deep reactive ion etching (Deep RIE) as is known in the art, with equipment such as an STS plasma etcher. The Deep RIE process can form both the cavity etches and the nozzle etches. Alternatively, the cavity etch could be realized with a wet etch process, such as potassium hydroxide (KOH) or tetra-methyl-ammonium-hydroxide (TMAH) in the case of silicon or hydrofluoric acid in the case of glass or quartz. The nozzle etch could then proceed from the opposite side of the wafer with a reactive ion plasma etch process. The nozzle plate could also be formed from injection molded plastic with laser machined nozzles, or from precision machined steel, for example.

Since specific vertical cavity dimensions may be required in accordance with the present invention, in order to fabricate such dimensions accurately precision polishing, such as chemical mechanical polishing, CMP, for example, of the nozzle wafer prior to etching of the cavities and the nozzles can occur.

The mating of the substrate and the nozzle plate can proceed via anodic bonding, as is known in the art, or by other means. Examples of other means include, but are not limited to, electroplating bonds, pressure bonds, epoxy bonds, and thermal bonds.

One aspect of the current invention is to provide alignment structures 60 in both the nozzle plate, which is a unitary structure for each of the different droplet ejectors, and the substrate to facilitate the mating process. These can be structures whose only purpose is to facilitate optical alignment, or these can be mechanical structures that physically guide the substrate and the nozzle plates, which can essentially be formed as two wafers, to a good fit, as shown schematically in FIG.

It is also noted that if the ejectors of the present invention need to be cleaned that an cleaning solution, such as an organic solvent like acetone or an alcohol or the like, can be ejected. Preferably, however, the ejector will consistently be used with one color or one nucleotide, for instance, whether it has been cleaned or not.

While the present invention has been described herein with reference to particular embodiments thereof, a latitude of modification, various changes and substitutions are intended in the foregoing disclosure. Accordingly, it will be appreciated that in some instances some features of the invention will be employed without a corresponding use of other features without departing from the spirit and scope of the invention as set forth in the appended claims.

We claim:

1. A droplet ejector capable of ejecting a liquid comprising:

a housing defining a cavity of predetermined dimensions;

a refill channel connected to the cavity that allows for the infusion of the liquid into the cavity; and a nozzle formed in the cavity; and an ultrasonic excitation source capable of ultrasonically exciting the liquid at a resonance frequency determined by dimensions of the cavity, such that the ultrasonic excitation at the resonance frequency provides sufficient pressure to completely eject a droplet of the liquid disposed in the cavity through the nozzle.

2. A droplet ejector according to claim 1 wherein flow resistance across the refill channel is greater than flow resistance across the nozzle.

3. A droplet ejector according to claim 1 wherein the ultrasonic excitation source includes a piezoeleetic element.

4. A droplet ejector according to claim 1 wherein the ultrasonic excitation source includes an electrostatically excited diaphragm.

5. A droplet ejector according to claim 1 wherein the ultrasonic excitation source includes a piezoelectrically excited diaphragm.

6. A droplet ejector according to claim 1 wherein the housing includes a substrate, a nozzle plate, and alignment structure for mating the nozzle plate and the substrate.

7. A droplet ejector according to claim 6 wherein the ultrasonic excitation source is formed within the housing on the substrate.

8. A droplet ejector according to claim 7 wherein the ultrasonic excitation source includes a piezoelectric element.

9. A droplet ejector according to claim 7 wherein the ultrasonic excitation source includes an electrostatically excited diaphragm.

10. A droplet ejector capable of ejecting a liquid comprising:

a housing defining a cavity of predetermined dimensions;

a refill channel connected to the cavity that allows for the infusion of the liquid into the cavity; and a nozzle formed in the cavity; and an ultrasonic excitation source capable of ultrasonically exciting the liquid at a resonant frequency and causing the ejection of a droplet of the liquid disposed in the cavity through the nozzle, wherein the largest dimension of the cavity is an order of magnitude smaller than the wavelength of sound in the liquid at the frequency of excitation.

11. A droplet ejector according to claim 10 wherein the maximum cavity dimension is 50 microns.

12. A method of forming an ultrasonic droplet ejector comprising the steps of providing a substrate that forms a portion of a cavity;

forming an ultrasonic excitation source on the substrate capable of providing excitation at a resonance frequency; and forming the remainder of the cavity over the ultrasonic excitation source, a refill channel and a nozzle being formed such that one end of the refill channel opens to the cavity, and one end of the nozzle opens to the cavity, and wherein the refill channel presents a larger flow resistance than the nozzle so that droplet ejection occurs through the nozzle and regurgitation is prevented and wherein the resonance frequency is determined by dimensions of the cavity so that ultrasonic excitation at the resonance frequency provides sufficient pressure to completely eject the droplet.

13. A method according to claim 12 wherein the step of forming the ultrasonic excitation source forms a piezoelectric element on the substrate.

14. A method according to claim 12 wherein the step of forming the ultrasonic excitation source forms an electrostatically excited diaphragm on the substrate.

15. A method according to claim 12 wherein the step of forming the ultrasonic excitation source forms an piezoelectrically excited diaphragm on the substrate.

16. A method according to claim 12 wherein the step of forming the remainder of the cavity includes the step of aligning a nozzle plate with the substrate using an alignment structure.

17. A method according to claim 16 wherein semiconductor processing techniques are used to create the refill channel, the nozzle, and the nozzle plate.

18. A method according to claim 12 wherein there are created a plurality of ultrasonic droplet ejectors, each ultrasonic droplet ejector being capable of being independently excitable.

19. A method according to claim 18 wherein a nozzle plate for all of the ultrasonic droplet ejectors is formed as a unitary structure.

20. A method according to claim 19 wherein the step of forming the remainder of the cavity includes the step of aligning the nozzle plate with the substrate using an alignment structure.

21. A method according to claim 20 wherein the substrate plate is a semiconductor wafer.

22. A method according to claim 20 wherein the nozzle plate is a semiconductor wafer.

23. A method according to claim 20 wherein the nozzle plate is an insulator wafer.

24. A method according to claim 20 wherein the nozzle plate is a metallic plate.

25. A droplet ejector array capable of ejecting liquid comprising:

a plurality of housings each defining a cavity of predetermined dimensions;

a refill channel connected to each cavity that allows far the infusion of liquid into the cavity;

a nozzle formed in each cavity;

and an ultrasonic excitation source associated with each cavity capable of ultrasonically exciting the liquid at a resonance frequency determined by the predetermined dimensions of the associated cavity, such that the ultrasonic excitation at the resonance frequency provides sufficient pressure to completely eject a droplet of the liquid disposed in the associated cavity through the nozzle formed in each respective cavity.

26. A droplet ejector array according to claim 25 wherein flow resistance across each refill channel is greater than flow resistance across each associated nozzle.

27. A droplet ejector array according to claim 25 wherein each ultrasonic excitation source includes a piezoelectric element.

28. A droplet ejector array according to claim 25 wherein each ultrasonic excitation source includes an electrostatically excited diaphragm.

29. A droplet ejector array according to claim 25 wherein all housings are formed from a single substrate mated to a single nozzle plate, and further including alignment structures for mating the nozzle plate and the substrate.

30. A droplet ejector array according to claim 29 wherein each ultrasonic excitation source is formed within the associated housing on the substrate.

31. A droplet ejector array according to claim 30 wherein each ultrasonic excitation source includes a piezoelectric element.

32. A droplet ejector array according to claim 30 wherein each ultrasonic excitation source includes an electrostatically excited diaphragm.

33. A droplet ejector array according to claim 25 wherein the plurality of housings are formed in an array and are grouped in sets having a predetermined number of housings within the set.

34. A droplet ejector array according to claim 33 wherein the predetermined number is four.

35. A droplet ejector array according to claim 33 usable for color printing such that the liquid stored in each different housing within a set is for a different color ink.

36. A droplet ejector array according to claim 33 usable for DNA chip printing such that the liquid stored in each different housing within a set is for a different nucleotide.

37. A droplet ejector array capable of ejecting liquid comprising:

a plurality of housings each defining a cavity of predetermined dimensions;

a refill channel connected to each cavity that allows for the infusion of liquid into the cavity;

a nozzle formed in each cavity; and an ultrasonic excitation source associated with each cavity capable of exciting the liquid in the associated cavity at a resonant frequency of the associated cavity to cause the ejection of a droplet of the liquid disposed in each respective cavity through the nozzle formed in each respective cavity and wherein the largest dimension of each cavity is an order of magnitude smaller than the wavelength of the liquid.

38. A droplet ejector array according to claim 37 wherein the maximum cavity edge dimension is 50 microns.

* * * * *